US005541713A

United States Patent [19]

Takatsuki et al.

[11] Patent Number: 5,541,713

[45] Date of Patent: Jul. 30, 1996

[54] DEVICE FOR ESTIMATING A SIZE OF AN ORIGINAL DOCUMENT

[75] Inventors: Yasushi Takatsuki; Takehiko Okada, both of Osaka, Japan

[73] Assignee: Mita Industrial Co., Ltd., Osaka-fu, Japan

[21] Appl. No.: 370,916

[22] Filed: Jan. 10, 1995

[30] Foreign Application Priority Data

Jan. 14, 1994 [JP] Japan ..... 6-002574

[51] Int. Cl.[6] ..... G03G 21/00

[52] U.S. Cl. ..... 355/235; 355/233

[58] Field of Search ..... 355/230, 233, 355/235, 75

[56] References Cited

U.S. PATENT DOCUMENTS 4,456,372 6/1984 Yamauchi ..... 355/75

4,814,833 3/1989 Matsushita et al. ..... 355/75

4,974,022 11/1990 Nezu ..... 355/230

5,119,130 6/1992 Tsudaka et al. ..... 355/75 X

*Primary Examiner*—Nestor R. Ramirez

*Attorney, Agent, or Firm*—Jordan and Hamburg

[57] ABSTRACT

An original document size estimating device includes a first optical sensor and a second optical sensor operable to detect an original document placed on a specified position. The first optical sensor is positioned before the second optical sensor with respect to a forward direction. The first and second optical sensors are moved in both the forward direction and a backward direction opposite to the forward direction by a driver. The driver is controlled in such a manner as to forcibly move the first and second optical sensors in the forward direction further a predetermined additional distance when the first optical sensor generates absence signal and the second optical sensor generates presence signal, and return them after both generating absence signal to measure a length of the original document for size estimation.

8 Claims, 7 Drawing Sheets

DEVICE FOR ESTIMATING A SIZE OF AN ORIGINAL DOCUMENT

BACKGROUND OF THE INVENTION

This invention relates to a device for estimating a size of an original document placed on a contact glass plate of an image forming apparatus such as a copying machine, and more particularly to an original document size estimating device which estimates a size of an original document by detecting a rear end edge of the original document.

In conventional size estimating devices for automatically estimating a size of an original document placed on a contact glass plate, numerous photosensors are provided at various positions under the contact glass plate so that the size of each original document can be logically estimated based on detection signals of these photosensors. There have been known size estimating devices in which a rear end edge of an original document is detected by a photosensor shiftable together with an optical system, and a size of the original document is estimated based on a detected position of rear end edge and a predetermined sheet size classification, e.g., A-standardized size or B-standardized size.

However, in the former devices, there has been the difficulty of placing numerous photosensors at appropriate places to logically and effectively detect an original document without causing interference with the optical system due to the fact that the optical system is normally located under the contact glass plate and reciprocates along the lower surface of the contact glass plate to read or scan images on the original document. Thus, a special arrangement has been required to avoid the interference between the numerous photosensors and the optical system, resulting in a complicated arrangement and bringing an undesirable increase of size.

Also, the latter devices have not been sufficiently reliable for the likelihood that an original document containing a relatively large black area is wrongly estimated to be a smaller size than an actual size because a border between the relatively large black area and a usual white background region is likely to be erroneously judged as a rear end edge. It will be seen that this wrong estimation results in a failure of copying an original image on an insufficient size copy sheet.

SUMMARY OF THE INVENTION

It is an object of the present invention to provide a device for estimating a size of an original document which has overcome the above-mentioned problems in the prior art.

It is another object of the present invention to provide a device for estimating a size of an original document which can accurately estimate a size of an original document even if the original document having a relatively large black area.

An original document size estimating device of the present invention comprises: a first optical sensor and a second optical sensor operable to detect an original document placed on a specified position; the first and second optical sensors each generating: a presence signal indicative of presence of an original document when receiving light reflected from the original document; and an absence signal indicative of absence of an original document when not receiving light reflected from the original document; the first optical sensor being positioned before the second optical sensor with respect to a forward direction; and the second optical sensor having an initial position near a front end edge of an original document; a driver operable to move the first and second optical sensors in both the forward direction and a backward direction opposite to the forward direction; a driver controller operable to control the driver to: move the first and second optical sensors in the forward direction from the initial position and move them when the first and second optical sensors generate the presence signal; forcibly move the first and second optical sensors in the forward direction further a predetermined additional distance when the first optical sensor generates the absence signal and the second optical sensor generates the presence signal; and move the first and second optical sensors in the backward direction from a return position where the first and second optical sensors generate the absence signal after being forcibly moved forward the predetermined distance; a calculator operable to calculate a length the original document by subtracting a partial distance from the return position to a position where the second optical sensor firstly generates the presence signal in the movement of the backward direction from a whole distance from the initial position to the return position; a size estimator operable to estimate a size of the original document based on the calculated length.

With this size estimating device, after the first optical sensor generates the absence signal, the first and second optical sensors are further moved forward a predetermined additional distance. Thereafter, if the second optical sensor generates the absence signal, they are changed to the backward movement. However, if the first and second optical sensors generate presence signal after the forcible additional movement, they are moved further in the forward direction.

In the backward movement, a true rear end edge in the original document is detected by the second optical sensor. The partial distance from the return position to the rear end edge detection position of the second optical sensor is subtracted from the whole movement distance from the initial position to the return position to obtain a true length of the original document. The size estimator then estimates a size of the original document based on an obtained length. Accordingly, even if there is a relatively large black area on the original document, the wrong judgment will be prevented of judging a border of the black area as a rear end edge of the original document. This is because the optical sensors are forcibly moved forward further the predetermined distance to go beyond the black area even when the first optical sensor detects the black area. Consequently, a true length of the original document can be obtained, and the document size can estimated accurately.

It may be preferable that the additional distance of the forcible movement is changeable. The additional distance can be decreased for the case that the black area is expected not to be large. Accordingly, the estimation time is shortened.

The calculator may be constructed by: first measurement means for measuring a whole period during which the second optical sensor is moved from the initial position to the return position; second measurement means for measuring a partial period during which the second optical sensor is moved from the return position to the position where the second optical sensor firstly generates the presence signal in the movement of the backward direction; and calculating means for subtracting the partial period from the whole period to obtain a true period, and calculating a length of the original document based on the true period and the specified moving speed. In this construction, the length of an original document can be measured without stopping the first and second optical sensors.

Also, the calculator may be constructed by: a pulse counter operable to count up a number of pulses of the motor in the movement from the initial position to the return position, and count down the counted up pulse number in the movement from the return position to the position where the second optical sensor firstly generates the presence signal in the movement of the backward direction; and calculating means for calculating a length of the original document based on the counted pulse number. In this construction, a moved amount of the first and second optical sensors is calculated in the term of pulse number. Accordingly, the length of an original document can be measured more accurately.

The first and second optical sensors are integrally mounted on the illumination unit which is moved in the forward and backward directions. This will eliminate the necessity of special mechanism to move the first and second optical sensors, totally reducing the number of parts for the size estimating device.

The first and second optical sensors may be disposed in a region facing a minimum size of original document among a different sizes of original documents to be estimated. Further, it may be appreciated to provide a third optical sensor disposed at a position which is spaced away from the first and second optical sensors in a direction perpendicular to the forward and backward direction, and faces one of two types of original documents having the same length but different widths, but does not face the other. Such original documents as having the same length but different widths, whose size cannot be estimated only by the first and second optical sensors, can be estimated by the addition of the third optical sensor. This makes it possible to estimate a size of a wider variety of original documents.

The above and other objects, features and advantages of the present invention will become more apparent from the following detailed description which is to be read in conjunction with the accompanying drawings.

DETAILED DESCRIPTION OF THE PREFERRED EMBODIMENTS OF THE INVENTION

Figure 1:
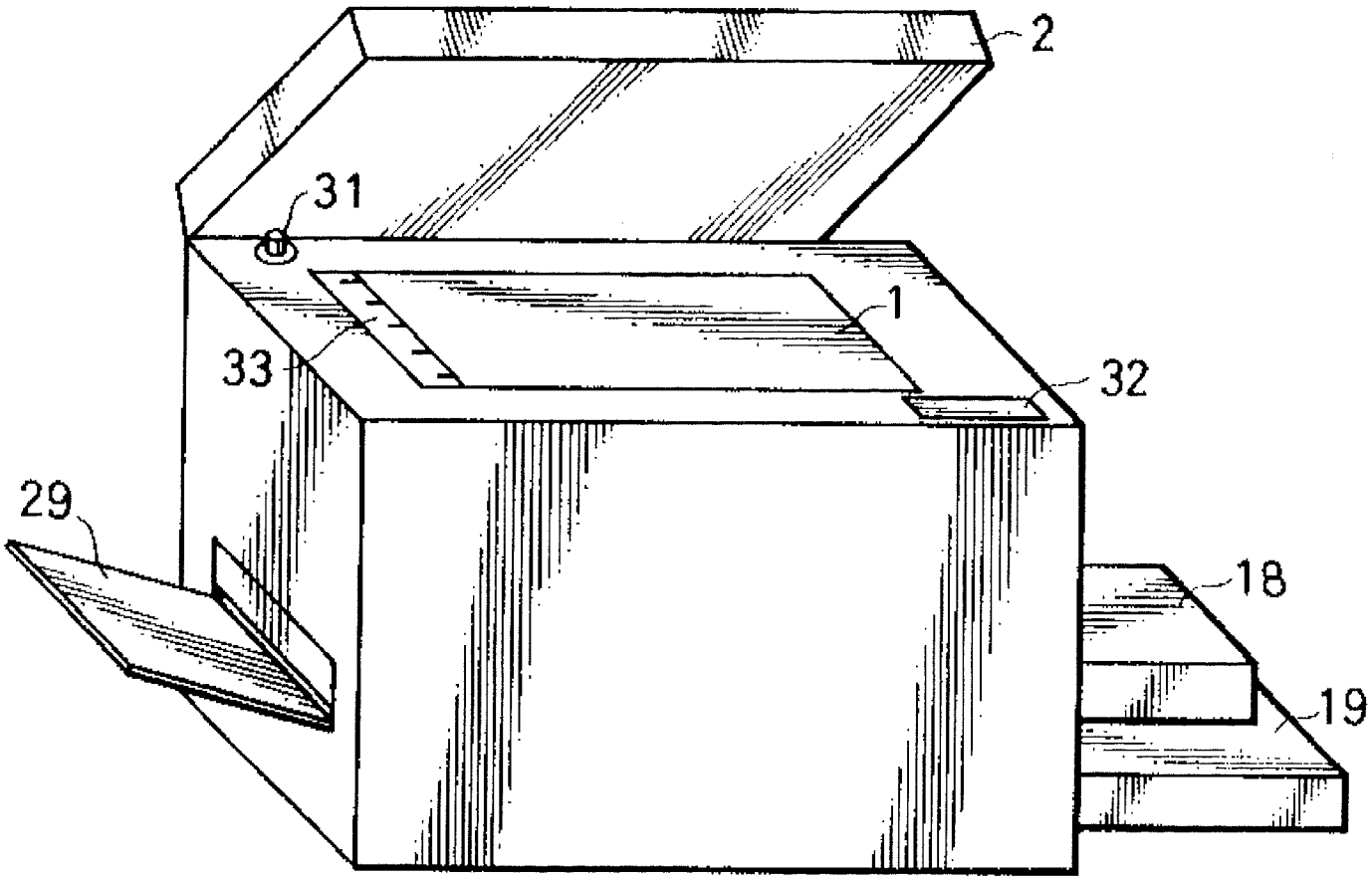
FIG. 1 is a perspective view showing an image forming apparatus provided with an original document size estimating device of the present invention.
Figure 2:
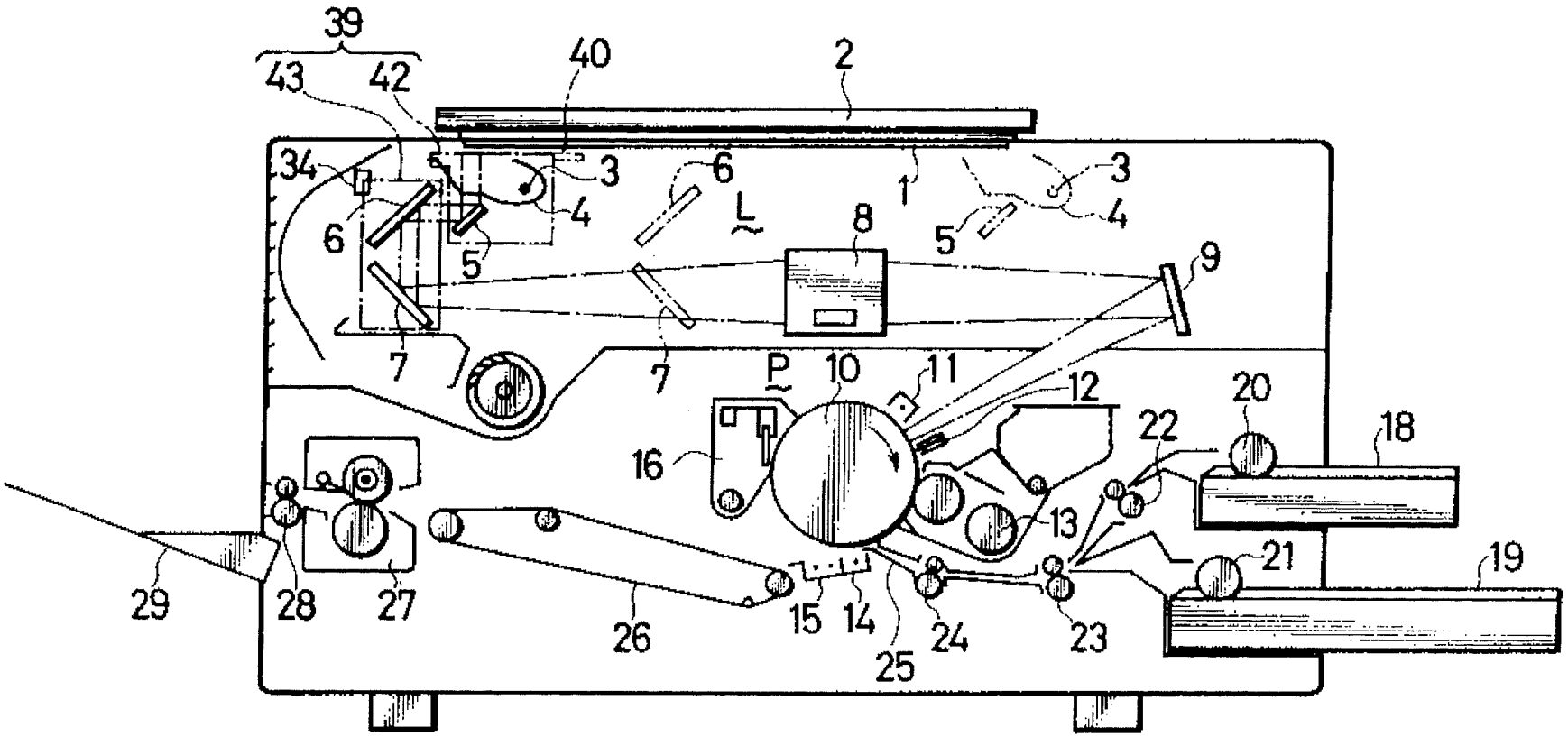
FIG. 2 is a schematic diagram showing an overall construction of the image forming apparatus.
Figure 3:
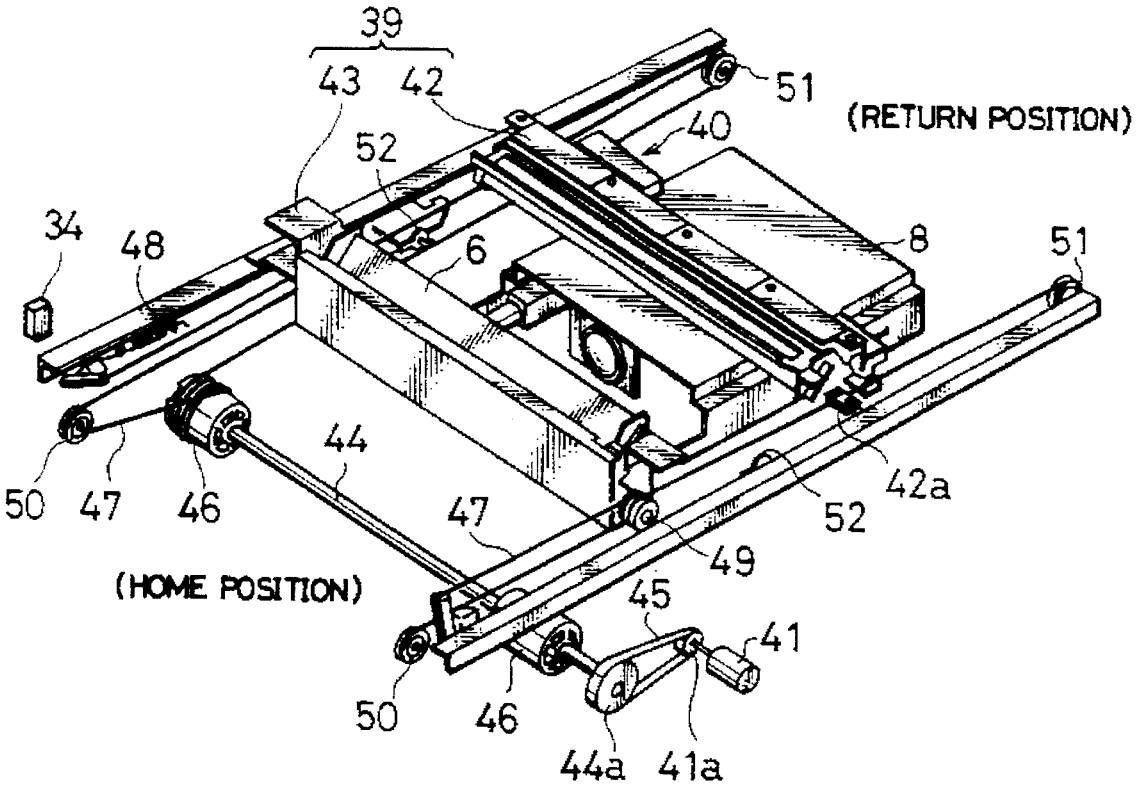
FIG. 3 is a perspective view showing a construction of an optical system of the image forming apparatus.

A preferred embodiment of the present invention will be described with reference to the accompanying drawings. FIG. 1 shows an external view of an image forming apparatus employing an original document size estimating device of the present invention. FIG. 2 schematically shows an overall construction of the image forming apparatus. FIG. 3 shows an optical system provided in the image forming apparatus.

As illustrated in FIG. 1, the image forming apparatus comprises a main body accommodating principal image forming components, a contact glass plate 1 provided in a top portion of the main body, a cover 2 hingedly mounted over the top portion, a cover switch 31 provided at a rear end of the top portion and near a base end of the cover 2, and an operation panel 32 disposed on a front end of the top portion.

The inside of the image forming apparatus is occupied by an optical system L, a toner image forming system P, a copy sheet transporting system, and others. A size reference member 33 is provided along a side end of the contact glass plate 1. Indicias indicative of a number of standardized sheet sizes, such as A4, B5, A3, are depicted on the size reference member 33 as a guide for placing an original document in position.

The cover switch 31 is turned on when the cover 2 is closed, and is turned off when the cover 2 is incompletely opened. The cover switch 31 detects the opening and closing of the cover 2.

Figure 6:
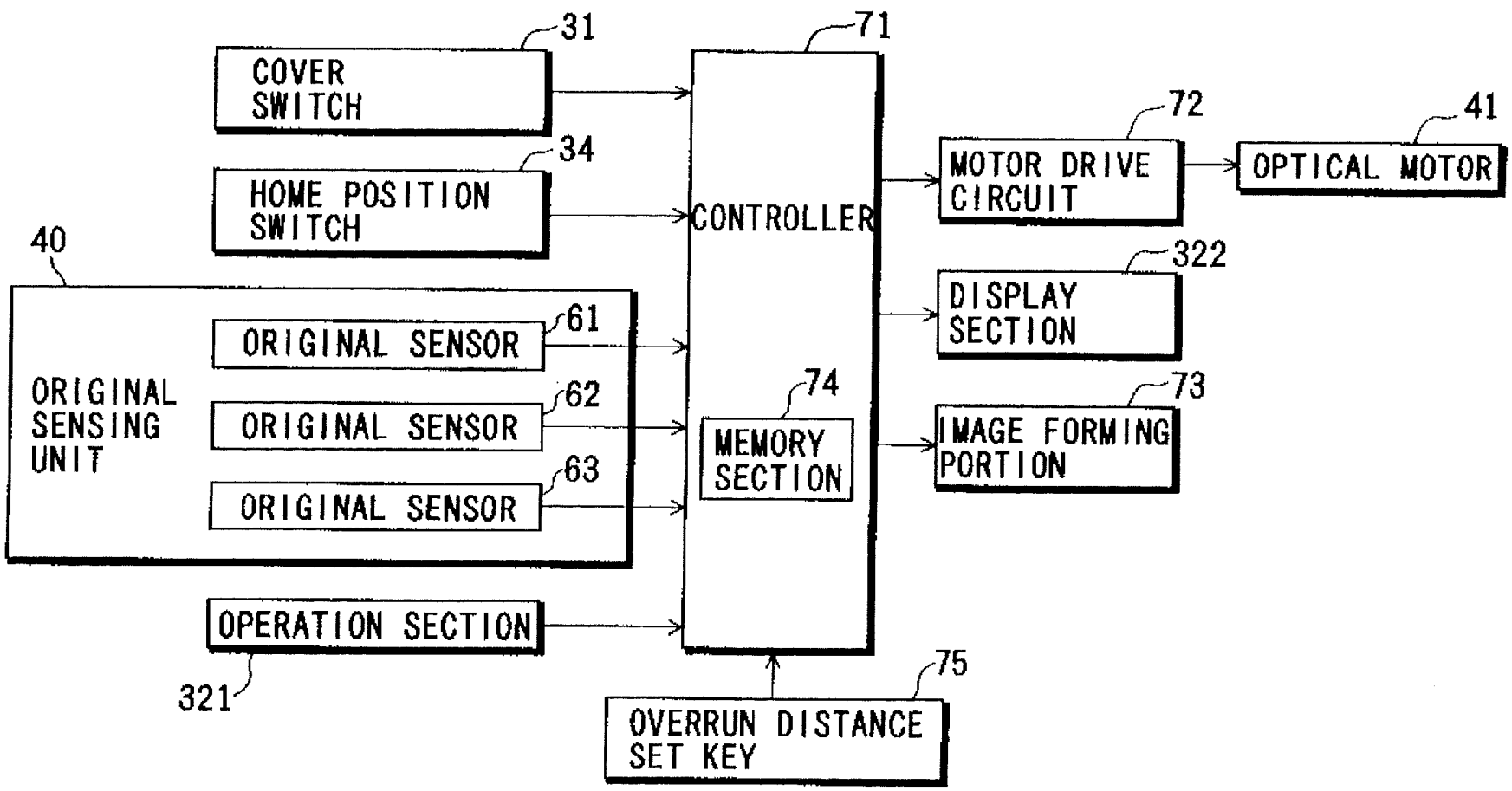
FIG. 6 is a block diagram showing a control system of the image forming apparatus.

The operation panel 32 comprises an operation section 321 and a display section 322 as shown in FIG. 6. The operation section 321 includes, for example, a ten key, a copy key, a document size selection key, and cassette selection key. The display section 322 includes, for example, an LED or an LCD to display various information such as an document size and a copy number.

As illustrated in FIGS. 2 and 3, the optical system L comprises a scanning unit 39 including a lamp portion 42 and a mirror portion 43, and a lens unit 8 for guiding light reflected from an original document exposed in scanning operation to a photosensitive drum 10.

The lamp portion 42 includes an exposure lamp 3, a reflecting member 4, a reflecting mirror 5, and an original document sensing unit 40. The mirror portion 43 includes reflecting mirrors 6 and 7. The exposure lamp 3 and the reflecting member 4 constitute a light source. The reflecting mirrors 5, 6 and 7 cooperatively form an optical path along which light goes to the photosensitive drum 10 after being reflected from the original document.

The lens unit 8 changes the magnification of image. A stationary mirror 9 reflects the light transmitted from the reflecting mirror 7 to the photosensitive drum 10.

An optical system motor 41, constituted for example by a stepping motor, is adapted for reciprocatively moving the scanning unit 39 between a home position or a left end of the optical system shown in FIG. 3 and a return position or a right end of the optical system shown in FIG. 3.

A pulley 41*a* fixedly attached to an output shaft of the optical system motor 41 transmits a driving force to a pulley 44*a* fixedly attached to a drive shaft 44 by way of an endless belt 45. Consequently, the driving force of the optical system motor 41 is transmitted to the drive shaft 44.

A pair of drums 46 and 46 are fixedly attached on both ends of the drive shaft 44, and rotated in a forward direction or a backward direction a predetermined amount by the optical system motor 41.

The lamp portion 42 is connected at its front and rear connectors 42*a*, 42*a* (only the front portion 42*a* is shown in FIG. 3) to wires 47, 47 extending in parallel with each other.

The mirror portion 43 is provided with pulleys 49, 49 (only the front pulley 49 is shown in FIG. 3) at its front and rear ends.

Respective one ends of the wires 47, 47 are fixedly attached to springs 48 and 48 (only the left spring 48 is shown in FIG. 3) while the other ends are fixedly attached to stationary members 52 and 52 fixedly provided on the image forming apparatus. More specifically, the wires 47, 47 are wound from the springs 48, 48 to the stationary members 52, 52 on the pulleys 49, 49 of the mirror portion 43, pulleys 50, 50, drums 46, 46, pulleys 51, 51, connectors 42*a*, 42*a* of the lamp portion 42.

The pulleys 49, 49 are rotatably mounted on the mirror portion 43. Accordingly, the pulley 49 functions as a running block in the drive transmission system. The lamp portion 42 moves twice faster than the mirror portion 43 attached with the pulleys 49, thereby keeping the distance between an illuminated portion of an original document and the lens unit 8 constant. The moving amounts of the lamp portion 42 and the mirror portion 43 or rotational amount of the optical system motor 41 is controlled by a pulse signal supplied to the optical system motor 41.

Indicated at 34 is a home position switch including a reflection type photosensor having a light emitting portion and a light receiving portion. The home position switch 34 is disposed at such a position as to confront the mirror portion 43 when the mirror portion 43 is in the home position. Judgment is made as to whether or not the lamp portion 42 and the mirror portion 43 are in the home position based on a signal from the home position switch 34.

The original document sensing unit 40 includes a rectangular base plate 60 on which three original document sensors 61, 62 and 63 and a required circuit components are arranged. The base plate 60 is installed on the lamp portion 42. The original document sensors 61, 62 and 63, being made of a reflection type photosensor having a light emitting portion and a light receiving portion, detect an original document based on presence or absence of light reflected from the original document under the condition where the original document is placed on the contact glass plate 1 and the cover 2 is opened.

Figure 4:
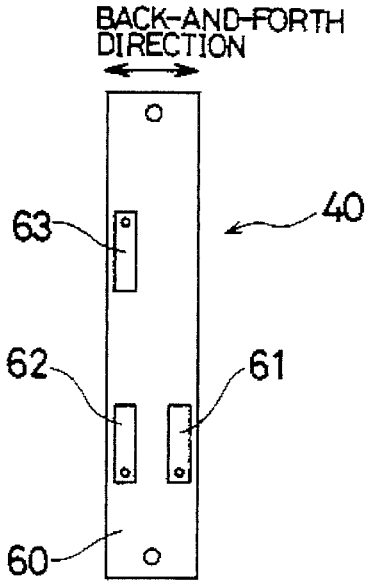
FIG. 4 is a top plan view showing an original document sensing unit provided in the image forming apparatus.

As shown in FIG. 4, two sensors of the three sensors, that is, the original document sensors 61 and 62, are arranged in parallel with each other in a moving direction of the scanning unit 39. The remaining sensor, i.e., the original document sensor 63, is aligned with the original document sensor 62 in a direction perpendicular to the moving direction. The original document sensors 62 and 63 are disposed at a closer position to the home position with respect to the original document sensor 61. The original document sensors 61 and 62 are spaced away from each other at a predetermined distance, and disposed at a closer position to a center of a copy sheet with respect to the original document sensor 63.

Further, the original document sensors 61 and 62 are disposed at a region which is to be covered by original documents corresponding to all the predetermined number of standardized sizes of copy sheet. On the other hand, the original document sensor 63 is disposed at a region which is to be covered by an original document corresponding to a smaller standardized size copy sheet when the original document is placed on the contact glass plate 1 with its shorter side being in parallel with the moving direction, but not to be covered by the same document when placed on the contact glass plate 1 with its longer side being in parallel with the moving direction.

Figure 5:
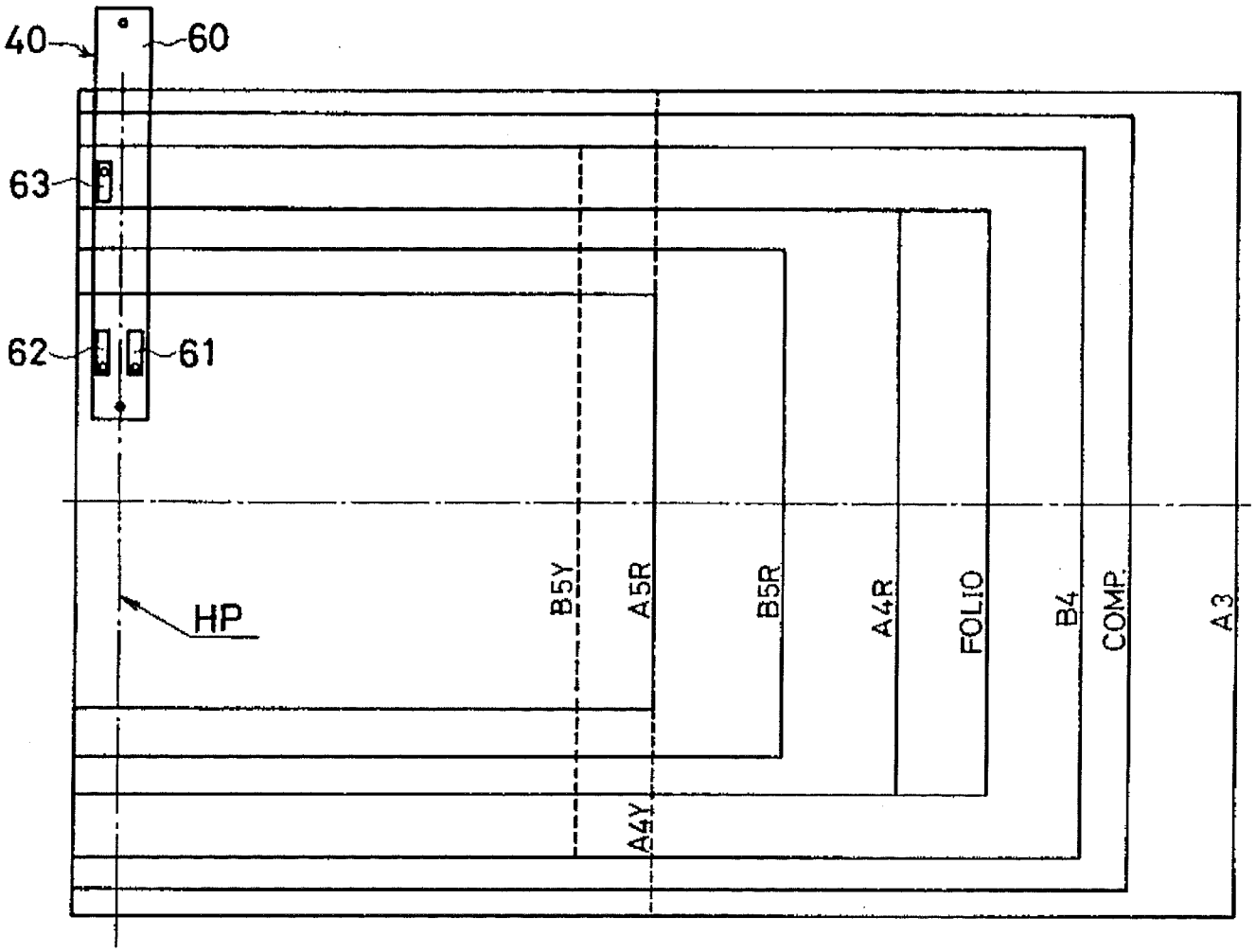
FIG. 5 is a diagram showing a relationship between positions of original document sensors and original documents corresponding to various standardized sizes of copy sheets.

More specifically, referring to FIG. 5, the respective positions of the original document sensors 61 to 63 with respect to sizes of original document will be described below. FIG. 5 illustrates a specific case where original documents corresponding to standardized size copy sheets ranging from B5 to A3, that is, B5Y, A5R, A4Y, B5R, A4R, FOLIO, B4, COMP, and A3 size copy sheets. The B5Y sheet and the B5R sheet have the same size but different placement positions. The A4R sheet and the A5R sheet have the same size but different placement positions.

Original documents but those of A5R and A4Y size have different lengths in the moving direction of the sensing unit 40 carrying the original document sensors 61 and 62. The size of these original documents can be estimated based on the length in the moving direction of the sensing unit 40.

However, an original document of A5R size and an original document of A4Y size have the same length in the moving direction of the sensing unit 40. Accordingly, the size of these original documents cannot be estimated only based on the length in the moving direction of the sensing unit 40. For this reason, the original document sensor 63 is provided to detect the length in the direction perpendicular to the moving direction. Specifically, the original document sensor 63 is provided at a region which is to be covered by the A4Y size document but not to be covered by the A5R size document.

Further, in the case that the contact glass plate 1 has a large area which makes it possible to place an A3 size document in such a manner that the shorter side of the A3 size document is in parallel with the moving direction, the shorter side of a B4 size document becomes identical with the length of a B5R size document, and the shorter side of an A3 document also becomes identical with the length of an A4R document. In this case, the size of these documents can be estimated by providing the original document sensor 63 in a region which is to be covered by a 84 size document but not to be covered by an A4R size document.

Referring to FIG. 2, the toner image forming system P includes the photosensitive drum 10 on which a latent image is to be formed, a charger 11 for charging the photosensitive drum 10 to a predetermined positive electric level, a blank lamp 12 for removing an unnecessary charged portion from the photosensitive drum 10, a developing unit 13 for feeding negatively charged toner onto a formed latent image to develop a toner image, a transfer unit 14 provided with positive DC electric power source for transferring a toner image onto a copy sheet, a separating unit 15 provided with an AC electric power source for separating the copy sheet from the photosensitive drum 10, and a cleaning unit 16 for removing residual toner from t he surface of the photosensitive drum 10 for next image forming.

An upstream portion of the copy sheet transporting system includes, along the transporting direction, a plurality of cassettes 18, 19 for storing different sizes of copy sheets, feed rollers 20, 21 for feeding a copy sheet out of the cassettes 18, 19, pairs of rollers 22, 23, a pair of registration rollers 24, and a transport guide 25 for guiding a copy sheet.

Also, a downstream portion of the copy sheet transporting system includes a belt 26 for transporting a COPY sheet, a fixing unit 27 for fixing a toner image on a copy sheet, and a pair of discharge rollers 28 for discharging a copy sheet bearing a copy image to a tray 29.

Although only two cassettes are shown in this embodiment, it is needless to say that the number of cassettes can be increased desirably according to the need.

Next, the control system of the image forming apparatus will be described with reference to a block diagram shown in FIG. 6.

A controller 71 including a micro computer centrally controls the operation of the image forming apparatus. A memory section 74 including an ROM and RAM is incorporated in the controller 71. Operation signals are sent from the operation section 321 to the controller 71. Based on these signals, the controller 71 controls the image forming portion 73, i.e., the photosensitive drum 19, the feed rollers 20, 21, and other parts to perform the image forming operation.

The memory section 74 is adapted for storing a number of reference distances between the home position of the original document sensing unit 40 and respective rear end edges of a number of reference documents corresponding to standardized sizes.

The controller 71 sends a control signal via a motor drive circuit 72 to control the optical system motor 41 to rotate in a forward direction or a backward direction and stop. The motor drive circuit 72 including transistors and others drives the optical system motor 41 on the basis of a control signal from the controller 71. The controller 71 controls the rotational speed of the optical system motor 41 based on the period of a pulse signal and controls the rotational amount based on the pulse number of the pulse signal. The scanning unit 39 carrying the original document sensing unit 40 moves to the return position when the optical system motor 41 is driven in the forward direction while the scanning unit 39 moves back to the home position when the optical system motor 41 is driven in the backward direction.

The controller 71 makes a judgment as to whether the cover 2 is opened or closed on the basis of a signal from the cover switch 31, and also makes a judgment as to whether or not the scanning unit 39 is in the home position on the basis of a signal from the home position switch 34. When the scanning unit 39 returns to the home position in response to the backward rotation of the optical system motor 41, the home position switch 34 detects arrival of the mirror portion 43 and generates a detection signal. Upon receiving this detection signal, the optical system motor 41 is immediately stopped.

When the cover 2 is opened and presence of an original document is detected by both the original document sensors 61 and 62, the controller 71 drives the optical system motor 41 to move the scanning unit 39 in the forward direction, letting the original document sensors 61 and 62 detect the original document. Once the original document sensor 61 detects absence of the original document, the controller 71 continues to drive the optical system motor 41 in the same direction for a while so that the document sensing unit 40 carried by the scanning unit 39 overruns a predetermined distance in the forward direction. When the document sensing unit 40 has overrun the above predetermined distance, the controller 71 stops the optical system motor 41 and then drives the scanning unit 39 in the backward direction to return the document sensing unit 40 to the home position. An overrun distance set key 75 has a function of changing the overrun distance of the original document sensing unit 40. Based on an input signal from this overrun distance set key 75, the controller 71 changes the overrun distance.

When the scanning unit 39 is moving in the backward direction, the original document sensor 62 detects presence of the original document. Just when detecting the original document in the backward movement of the scanning unit 39, it is judged that the original document sensor 62 detect a Fear end edge of the original document, and a distance between the home position and the position where the sensor 62 detects the original document is calculated. The size of the original document is estimated from the calculated distance.

The distance from the home position is calculated based on the number of pulses supplied to the optical system motor 41 and the moving amount per one pulse. Specifically the distance from the home position increases in proportion to the pulse number given when the optical system motor 41 rotates in the forward direction while the distance from the home position decreases in proportion to the pulse number given when the optical system motor 41 rotates in the backward direction. The memory section 74 stores thus calculated pulse number from the home position, thereby estimating a size of the original document.

The controller 71 controls the display section 322 to display an estimated document size.

Figure 7:
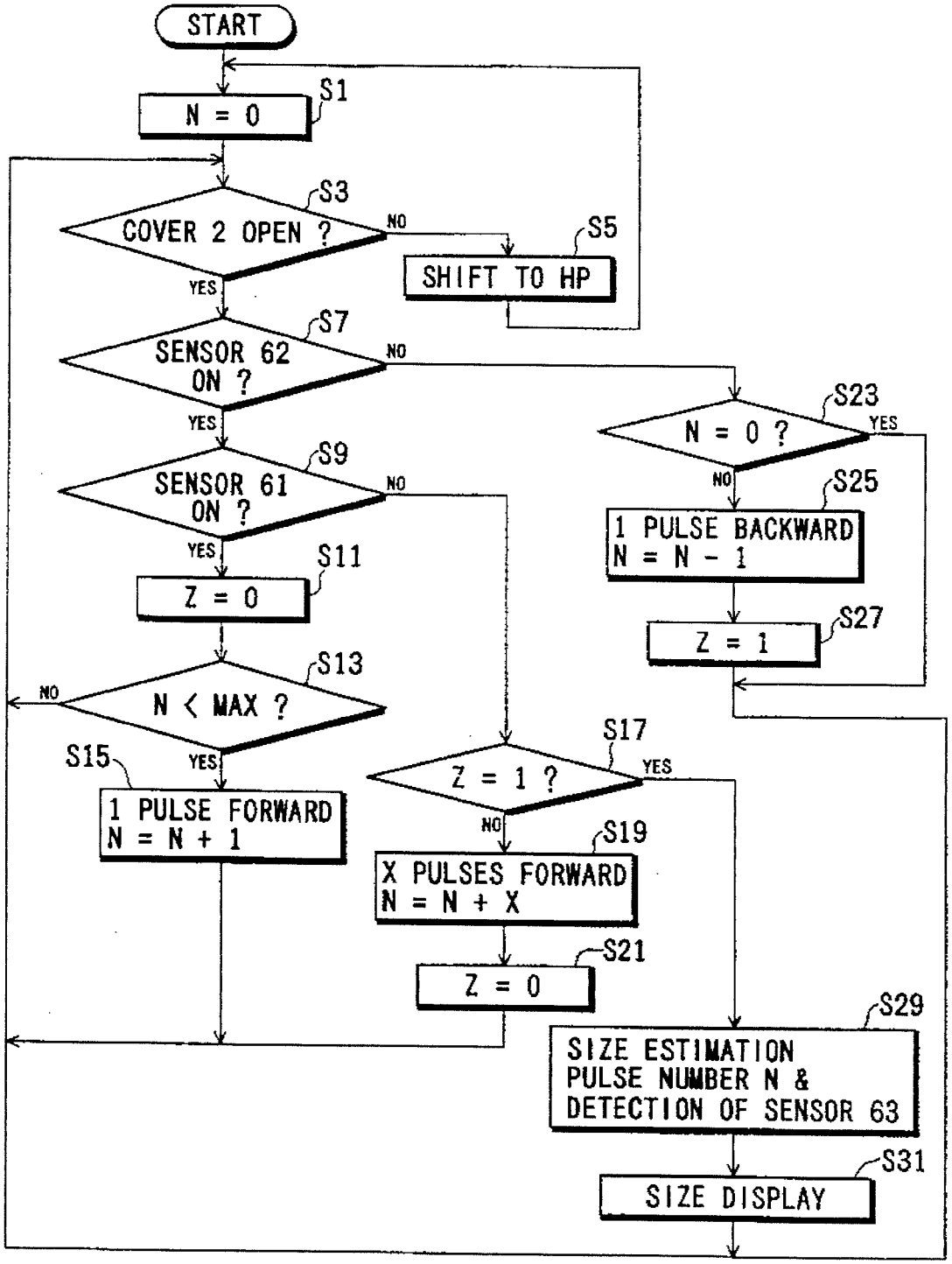
FIG. 7 is a flowchart showing a size estimation operation of the image forming apparatus.

Next, an original document size estimating operation of the image forming apparatus will be described with reference to flowchart shown in FIG. 7 together with the illustration shown in FIG. 5. In the flowchart of FIG. 7, a count flag N represents a rotational amount of the optical system motor 41, and a flag Z represents that the optical system motor 41 is rotating in the backward direction.

The count flag N is set to "N=0" in Step S1. If the cover 2 is not opened ("NO" in Step S3), the scanning unit 39 is moved to the home position (Step S5) and this routine returns to Step S1.

If the cover 2 is opened ("YES" is Step S3), it is judged in Steps S7 and S9 whether or not the original document sensors 62 and 61 each detect the original document. If the original document sensor 62 does not detect presence of the original document ("NO" in Step S7), this routine proceeds to Step S23. On the other hand, if the original document sensor 62 detects presence of the original document ("YES" in Step S7) and the original document sensor 61 does not detect presence of the original document ("NO" in Step S9), this routine proceeds to Step S17.

If both the original document sensors 62 and 61 detect presence of the original document ("YES" in Steps S7 and S9), the flag Z is set to "0" in Step S11. In Step S13, then, the judgment is executed in Step S13 whether or not the count flag N is smaller than a predetermined maximum value MAX. If the count flag N is smaller than the predetermined maximum value ("YES" in Step S13), the optical system motor 41 rotates in the forward direction by an amount corresponding to one pulse and the count flag N is incremented by "1" (i.e., N=N+1) in Step S15. Thereafter, this routine returns to Step S3 to repeat the abovementioned steps. In other words, as far as both the original document sensors 62 and 61 simultaneously detect presence of the original document, the optical system motor 41 is continuously driven in the forward direction step by step. Thus, the scanning unit 39 advances in the forward direction to scan the original document. On the other hand, if the count flag N reaches the maximum value MAX ("NO" in Step S13), the scanning unit 39 is not required to go further forward, and this routine returns to Step S3 without suspending the optical system motor 41.

In the case that the original document has a relatively large black area, the original document sensor 61 does not detect the document or detect absence of the original document. Accordingly. "NO" is judged in Step S9. This routine proceeds to Step SI7 where it is judged whether the flag is set to "1" If the flag Z is not set to "1" ("NO" in Step S17), the optical system motor 41 is driven in the forward direction by an amount corresponding to X pulses so as to cause the scanning unit 39 to move forward, and the count flag N is incremented by "X" in Step S19. In Step S21, the flag Z is reset to "O" to assure the "O" condition of the flag Z, and this routine returns to Step S3 to repeat the above-mentioned steps.

After the original document sensor 61 passes the relatively large black area on the original document owing to the X pulse forward movement, the original document sensors 62 and 61 again detect presence of the original document in Steps S7 and S9. The optical system motor 41 is continuously rotated in the forward direction in response to each pulse.

On the contrary, when the original document sensor 61 passes the rear end of the original document and therefore detects absence of the original document in Step S9, the original document sensor 62 no longer detects presence of the original document in Step S7 (i.e., "NO" in Step S7). In this case, it is judged in Step S23 whether or not the count flag N is set to "1". If the count flag N is not set to "1" ("NO" in Step S23), the optical system motor 41 is rotated in the backward direction by an amount corresponding to one pulse and the count flag N is decremented by "1" (i.e., N=N−1) in Step S25. Thereafter, the flag Z is set to "1" in Step S27, and this routine returns to Step S3 to repeat the above-mentioned steps. In other words, as far as the original document sensor 62 detects absence of the original document, the optical system motor 41 continuously rotates in the backward direction in response to each pulse. The scanning unit 39 returns toward the home position.

As described above, this embodiment is characterized in that the scanning unit 39, i.e., the original document sensing unit 40, is allowed to overrun a predetermined distance corresponding to X pulses after the original document sensor 61 has detected absence of the original document. This will prevent a leading border of a relatively large black area from being wrongly judged to be a rear end of the document.

When the count flag N is set to "0" ("YES" in Step S23), it is judged that the scanning unit 39 has reached the home position and is not required to be moved further in the backward direction. This routine returns to Step S3 without driving the optical system motor 41.

In this time, the original document sensor 62 detects presence of the original document ("YES" in Step S7) but the original document sensor 61 does not detect presence of the original document ("NO" in Step S9), and the flag Z is set to "1" ("YES" in Step S17). Accordingly, in Step S29, the size of the original document is estimated on the basis of the value of count flag N and a moved amount of the original document sensing unit 40 per pulse, and a detection of the original document sensor 63. An estimated size is displayed on the display section 322 in Step S31.

As shown in FIG. 5, the original document sensor 63 is adapted for discriminating an A4Y size original document from an ASR size original document which have the same length in the moving direction of the scanning unit 39.

As described above, the original document sensing unit 40 is moved in the forward direction a further predetermined distance after the original document sensor 61 detects absence of the original document and then moved in the backward direction. The predetermined distance is greater than a width of a possible black area. Accordingly, even if there is a relatively large black area on an original document, a rear end of the original document and a border of the relatively large black area can be assuredly discriminated, and the size of the original document can be accurately estimated.

If required, the overrun distance set key 75 is used to change the overrun distance. i.e., the number of pulses required for the overrun of the optical system motor 41. For example, in the case that black areas which are expected not to be large as frequently used original documents, the overrun distance is shortened by reducing the number of X pulses, thereby reducing the time of size estimation. 0n the other hand, in the case that a large full black area is seen, the overrun distance is increased to accurate discrimination of a rear end edge of an original document.

Figure 8:
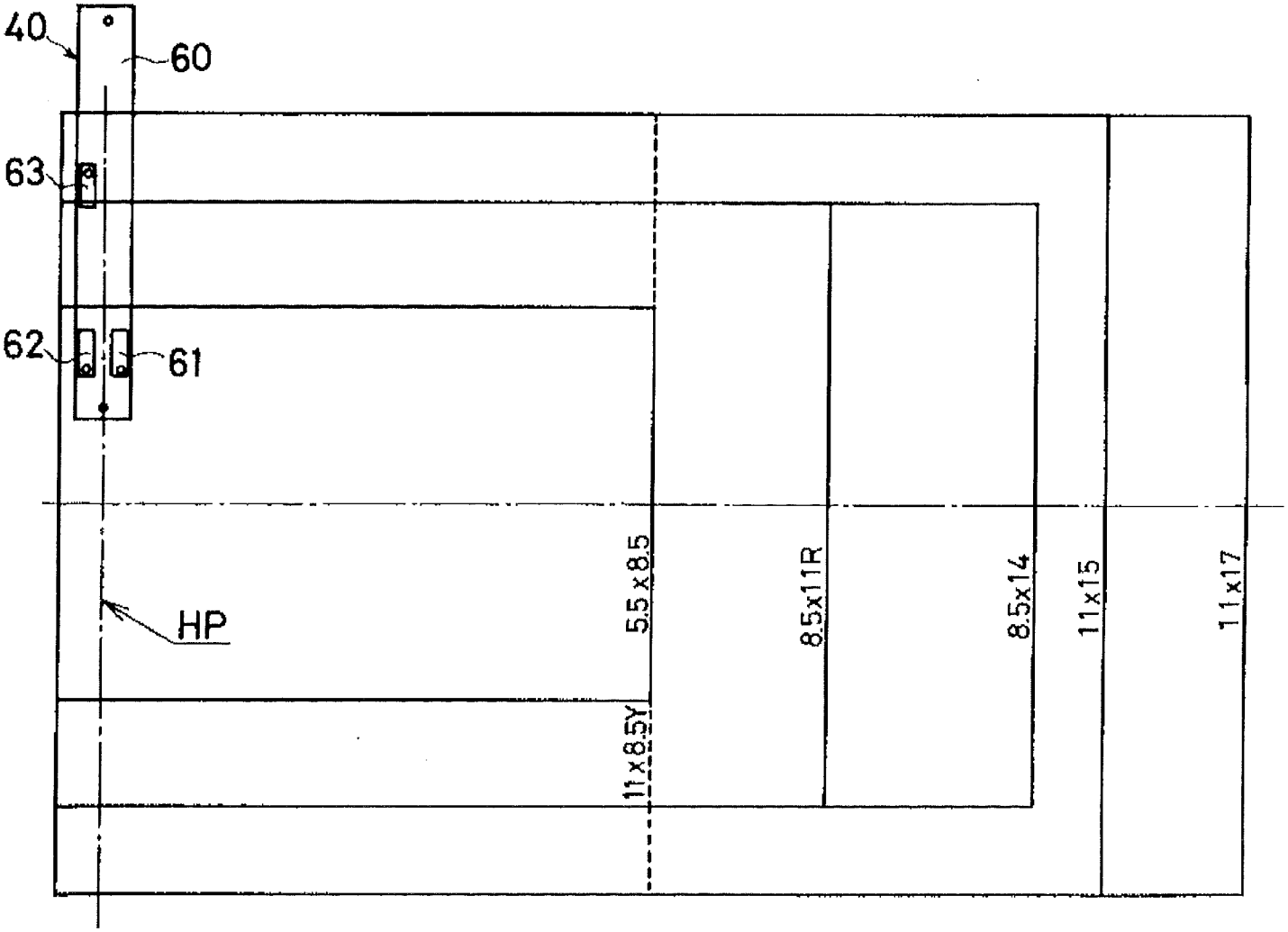
FIG. 8 is a diagram showing a relationship between positions of the original document sensors and original documents corresponding to various standardized sizes of copy sheets, similar to FIG. 5.

Furthermore, as shown in FIG. 8, the present invention can be applied equivalently to original documents having standardized sizes in terms of inches. In this case, it is preferable that the original document sensor 63 is disposed at a position not to be covered by a 5.5×8.5 size original document, but to be covered by a 11×8.5Y size original document to discriminate these two original documents which have the same length in the moving direction.

Next, a copying operation of the apparatus will be described. When the COPY key is depressed in the operation section 321, the charger unit charges the photosensitive drum 10 and the exposure operation is started. More specifically, light emitted from the exposure lamp 3 is reflected from the original document placed on the contact glass plate 1. This reflected light is guided by means of the reflection mirrors 5, 6 and 7 to the lens unit 8. The light reaches the photosensitive drum 10 after being reflected by the stationary mirror 9, thereby exposing a charged region on the photosensitive drum 10, and forming a latent image thereon.

Thereafter, negatively charged toner is supplied from the developing unit 13 onto the photosensitive drum 10 to attach the toner onto the latent image for development.

Meanwhile, a copy sheet having a size identical with the detected document size is fed from the corresponding cassette by the feed roller 20 or 21. The copy sheet, transported by the pair of rollers 22, 23, through the registration rollers 24 in synchronism with the development. The copy sheet is guided by the transport guide 25 to meet the surface of the photosensitive drum 10.

Subsequently, the toner image is transferred onto the copy sheet by the transfer unit 14 which is charged in positive. The copy sheet is separated from the photosensitive drum 10 by the separating unit 15 including an AC power source. The separated copy sheet is transported by the belt 26 to the fixing unit 27, where the toner image is fixed onto the copy sheet, and is discharged from the main body of the image forming apparatus through the rollers 28 to the tray 29.

It is preferable to suspend the copying operation, even if the copy key is depressed, during the size estimating operation, and allow the copying operation after the size estimating operation is entirely completed. Alternatively, it may be possible to stop the size estimating operation immediately when the copy key is depressed, and allow the copying operation in accordance with the a predetermined size.

It may be appreciated that if the document size selection key or cassette selection key is depressed before an original document is placed on the contact glass plate 1 or during the size estimating operation, the size estimating operation is stopped and the size selected by the selection key is preferentially set.

In the case that the cover 2 has a mirror surface on the underside thereof, it may be appreciated to use light emitters having a predetermined directionality as the light emitting portions of the original document sensors 61, 62 and place these light emitters at inclined positions with respect to the original document, whereby the light receiving portions of the original document sensors 61, 62 and 63 receive only light irregularly reflected from the original document, and detect presence of the original document even if the cover 2 is closed. Accordingly, this will enable elimination of the cover switch 31 and the operation of Step S3 of the flowchart of FIG. 7.

In the foregoing embodiment, a stepping motor is used for the optical system motor 41. However, it may be possible to use an AC or DC motor in place of a stepping motor. In the case of AC or DC motor, the operating time of the motor is measured, and a moved distance of the original document sensor 62 is calculated based on a measured operating period and a specified rotational speed of the motor which is stored in the memory section 74 in advance. Specifically, the period that the original document sensor 62 is moved forward from the home position to the return position, and the period that the original document sensor 62 is moved backward from the return position to a rear end edge of the original document. From these measured periods, the true operating period is calculated that the original document sensor 62 is moved between the home position and the rear end edge of the original document. The length of the original document is calculated from the true period and the rotational speed of the motor. In this case, the scanning unit 39 carrying the original document sensing unit 40 can be continuously moved. In other words, it is not required to stop the sensing unit 40 intermittently as the foregoing embodiment using a stepping motor.

What is claimed is:

1. A device for estimating the size of an original document comprising:

a first optical sensor and a second optical sensor operable to detect an original document placed at a specified position;

the first and second optical sensors each generating:

a presence signal indicative of the presence of an original document when receiving light reflected from the original document; and an absence signal indicative of the absence of an original document when not receiving light reflected from the original document;

a driver operable to move the first and second optical sensors in both a forward direction and a backward direction opposite to the forward direction;

the first optical sensor being positioned downstream from the second optical sensor with respect to the forward direction; and the first and second optical sensors having an initial position juxtaposed to a front end edge of an original document when said original document is in said specified position;

a driver controller operable to control the driver to:

move the first and second optical sensors in the forward direction from the initial position and move them when the first and second optical sensors generate the presence signal;

forcibly move the first and second optical sensors in the forward direction further a predetermined additional distance to a return position when the first optical sensor generates the absence signal and the second optical sensor generates the presence signal; and move the first and second optical sensors from the return position in the backward direction to a position where the second optical sensor generates a presence signal after having been forcibly moved forward the predetermined additional distance;

a calculator operable to calculate the length of the original document by subtracting the partial distance from the return position to a position where the second optical sensor first generates the presence signal in its movement in the backward direction from the entire distance from the initial position to the return position; and a size estimator operable to estimate the size of the original document based on the calculated length.

2. A device for estimating the size of an original document as defined in claim 1, further comprising means for changing the additional distance of the forcible movement of the first and second optical sensors.

3. A device for estimating the size of an original document as defined in claim 1, wherein:

the driver moves the first and second optical sensors in the forward and backward directions at a specified speed; and the calculator includes:

first measurement means for measuring the entire period during which the second optical sensor is moved from the initial position to the return position;

second measurement means for measuring the partial period during which the second optical sensor is moved from the return position to the position where the second optical sensor first generates the presence signal in its movement in the backward direction; and calculating means for subtracting the partial period from the entire period to obtain a true period, and calculating the length of the original document based on the true period and the specified moving speed.

4. A device for estimating the size of an original document as defined in claim 1, wherein:

the driver includes a pulse motor operable to move the first and second optical sensors in the forward and backward directions;

the driver controller controlling the pulses of the pulse motor;

the calculator including:

a pulse counter operable to count up the number of pulses of the motor in the movement from the initial position to the return position, and count down the number of pulses in the movement from the return position to the position where the second optical sensor first generates the presence signal in the movement in the backward direction; and calculating means for calculating the length of the original document based on the counted pulse numbers.

5. A device for estimating the size of an original document as defined in claim 4, wherein the driver controller changes the additional distance of the forcible movement by changing the number of pulses to be sent to the pulse motor.

6. A device for estimating the size of an original document as defined in claim 1, further comprising an illumination unit operable to illuminate the original document, wherein:

the first and second optical sensors are integrally mounted on the illumination unit; and the driver is operable to move the illumination unit in the forward and backward directions.

7. A device for estimating the size of an original document as defined in claim 1, wherein:

different sizes of original documents are able to be placed on the specified position, said different sizes having a first and a second side with said first side being shorter than said second side;

the first and second optical sensors being disposed in a region juxtaposed to said shorter side when said different sizes of original documents are placed at the specified position, said first and second optical sensors underlying said region when said different sides of original document are placed at the specified position.

8. A device for estimating the size of an original document as defined in claim 7, wherein the different sizes of original documents includes a first original document having a specified length and a specified width and a second original document having the same length as the first original document and a width shorter than the width of the first original document, further comprising a third optical sensor:

disposed at a position which is spaced away from the first and second optical sensors in a direction perpendicular to the forward and backward direction, said third optical sensor overlying said first original document when said first original document is placed at the specified position, said third optical sensor being displaced from overlying relationship with the second original document when the Second original document is in the specified position, said third optical sensor having a detection output, wherein the size estimator estimates the size of the first and second original document based on the calculated length and the detection output of the third optical sensor.

* * * * *